US009829285B1

(12) United States Patent
Kimblad et al.

(10) Patent No.: US 9,829,285 B1
(45) Date of Patent: Nov. 28, 2017

(54) TARGET HOLDING SYSTEM

(71) Applicants: Gustaf Henrik Folke Kimblad, Jarfalla (SE); Martin Borje Vestin, Koping (SE)

(72) Inventors: Gustaf Henrik Folke Kimblad, Jarfalla (SE); Martin Borje Vestin, Koping (SE)

( * ) Notice: Subject to any disclaimer, the term of this patent is extended or adjusted under 35 U.S.C. 154(b) by 0 days.

(21) Appl. No.: 15/160,951

(22) Filed: May 20, 2016

Related U.S. Application Data

(60) Provisional application No. 62/179,896, filed on May 22, 2015.

(51) Int. Cl.

| | |
|---|---|
| ***F41J 5/14*** | (2006.01) |
| ***F41J 1/10*** | (2006.01) |
| ***F41J 7/06*** | (2006.01) |
| ***F41J 7/04*** | (2006.01) |

(52) U.S. Cl.
CPC . *F41J 1/10* (2013.01); *F41J 7/04* (2013.01); *F41J 7/06* (2013.01)

(58) Field of Classification Search
CPC ..... F41J 1/10; F41J 7/04
USPC ..... 273/390, 407; 248/561, 900; 40/606.15, 40/608
See application file for complete search history.

(56) References Cited

U.S. PATENT DOCUMENTS

| | | | | |
|---|---|---|---|---|
| 5,676,378 | A * | 10/1997 | West | F41J 1/10 273/390 |
| 8,960,677 | B2 * | 2/2015 | Mickelson | F41J 1/10 269/69 |
| 2012/0205870 | A1 * | 8/2012 | Saunders | F41J 7/04 273/392 |
| 2015/0137455 | A1 * | 5/2015 | Pixton | F41J 1/10 273/407 |

* cited by examiner

*Primary Examiner* — Melba Bumgarner
*Assistant Examiner* — Laura L Davison
(74) *Attorney, Agent, or Firm* — Plager Schack LLP

(57) ABSTRACT

A target holding system is configured to hold a target struck by a bullet. The target holding system has a first bracket, connected to a second bracket with a first lateral support and a second lateral support. A central plate is connected to the first bracket and the second bracket and further comprising a first side first opening and a second side first opening. A rotating rod is rotatably connected to the first bracket and the second bracket and further comprising a first side slot and a second side slot. The target further comprises a central stem connected to a circular target, a first side leg and a second side leg. In a first mode of operation, the first side leg is slid through the first side slot and into the first side first opening while the second side leg is slid through second side slot and into the second side first opening. When the bullet strikes the circular target, the central stem remains upright. In a second mode of operation, the first side leg is slid through the first side slot and is adjacent to the central plate while the second side leg is slid through the second side slot and is adjacent to the central plate. When the bullet strikes the circular target, the central stem moves rotationally and downward.

1 Claim, 4 Drawing Sheets

TARGET HOLDING SYSTEM

RELATED APPLICATION

This application claims priority to provisional patent application U.S. Ser. No. 62/179,896 filed on May 22, 2015, the entire contents of which is herein incorporated by reference.

BACKGROUND

The embodiments herein relate generally to target shooting. Prior to embodiments of the disclosed invention, target shooting systems were either static or rotating, but not both. Embodiments of the disclosed invention solve this problem.

SUMMARY

A target holding system is configured to hold a target struck by a bullet. The target holding system has a first bracket, connected to a second bracket with a first lateral support and a second lateral support. A central plate is connected to the first bracket and the second bracket and further comprising a first side first opening and a second side first opening. A rotating rod is rotatably connected to the first bracket and the second bracket and further comprising a first side slot and a second side slot. The target further comprises a central stem connected to a circular target, a first side leg and a second side leg. In a first mode of operation, the first side leg is slid through the first side slot and into the first side first opening while the second side leg is slid through second side slot and into the second side first opening. When the bullet strikes the circular target, the central stem remains upright. In a second mode of operation, the first side leg is slid through the first side slot and is adjacent to the central plate while the second side leg is slid through the second side slot and is adjacent to the central plate. When the bullet strikes the circular target, the central stem moves rotationally and downward.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
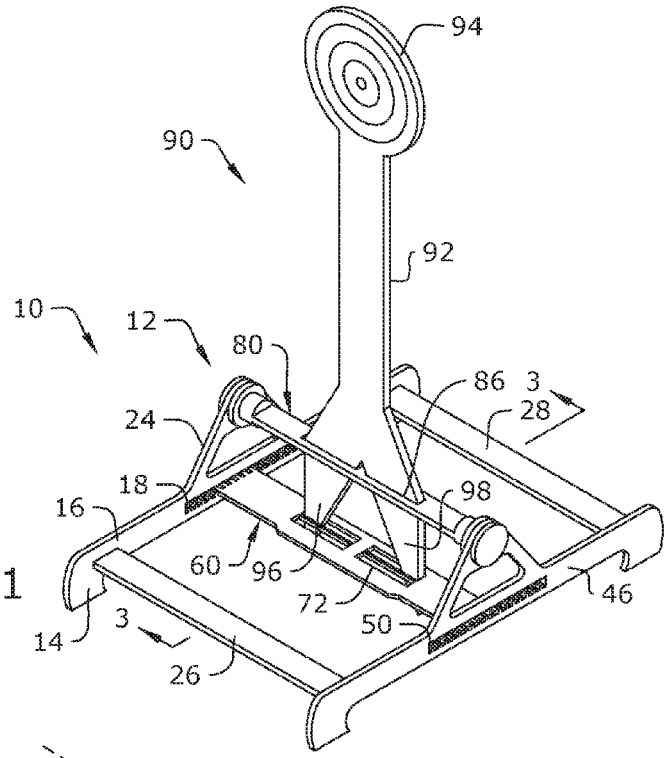
FIG. 1 shows a perspective view of one embodiment of the present invention.
Figure 2:
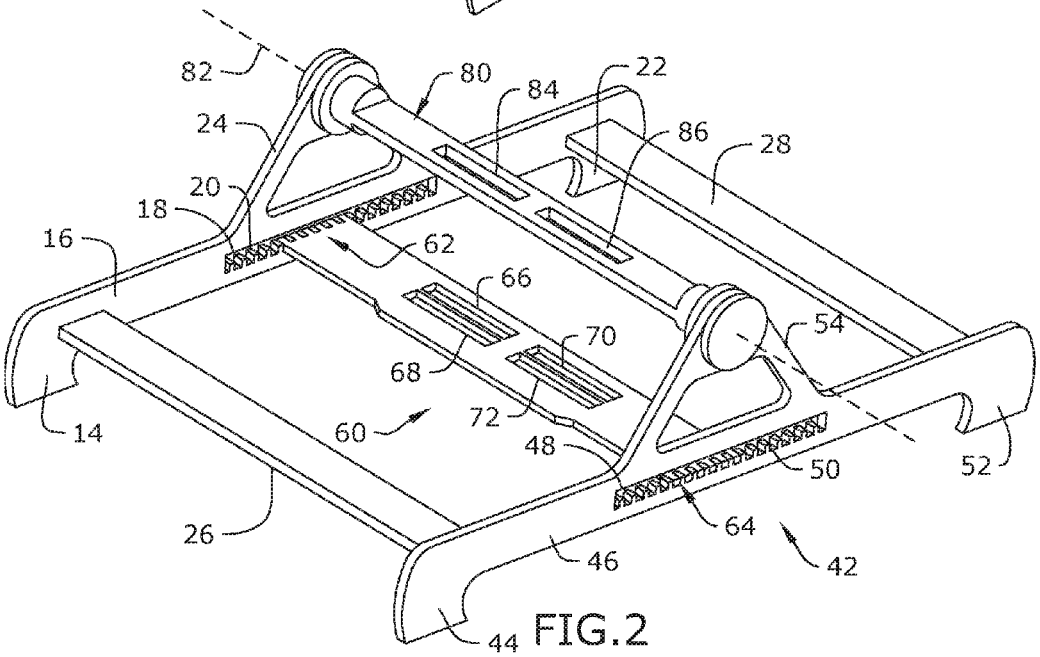
FIG. 2 shows a perspective view of one embodiment of the present invention.
Figure 3:
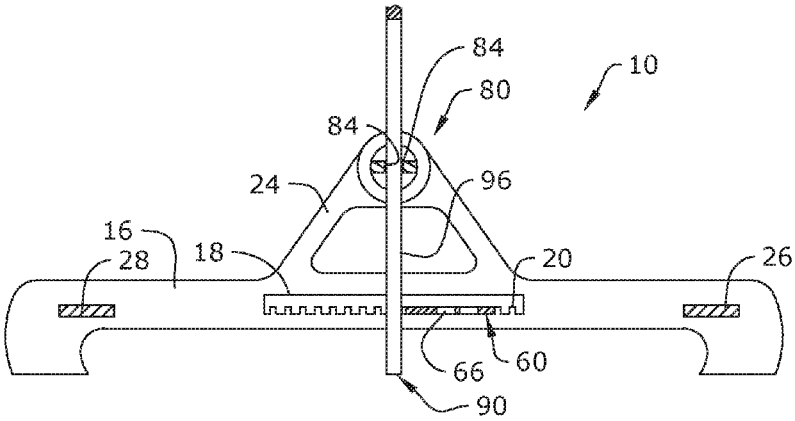
FIG. 3 shows a section view of one embodiment of the present invention along line 3-3 in FIG. 1.
Figure 4:
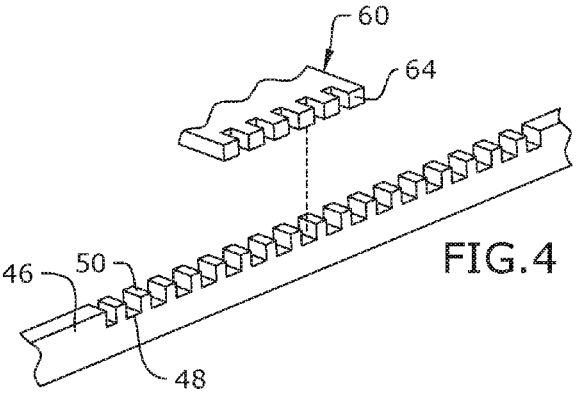
FIG. 4 shows a detail perspective view of one embodiment of the present invention.
Figure 5:
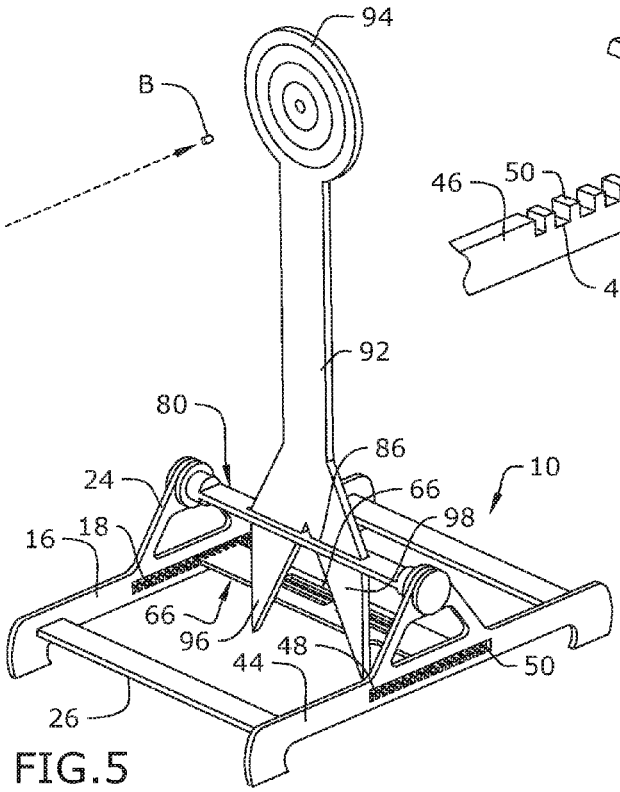
FIG. 5 shows a perspective view of one embodiment of the present invention in use.
Figure 6:
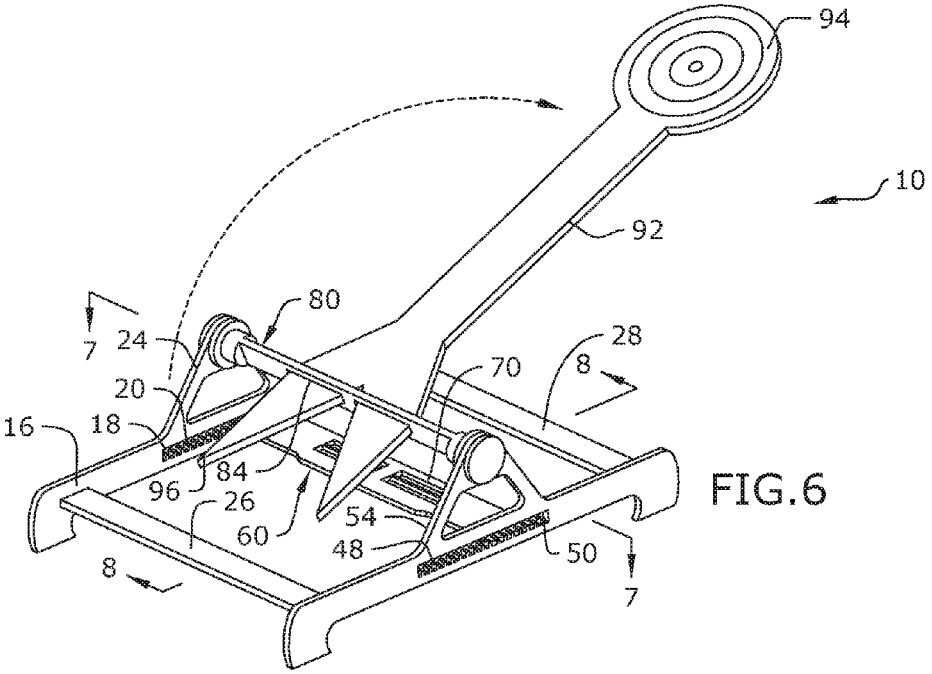
FIG. 6 shows a perspective view of one embodiment of the present invention in use.
Figure 7:
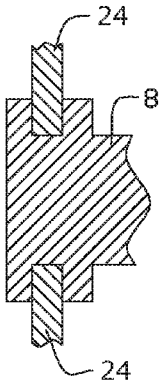
FIG. 7 shows a section view of one embodiment of the present invention taken along line 7-7 in FIG. 6.
Figure 8:
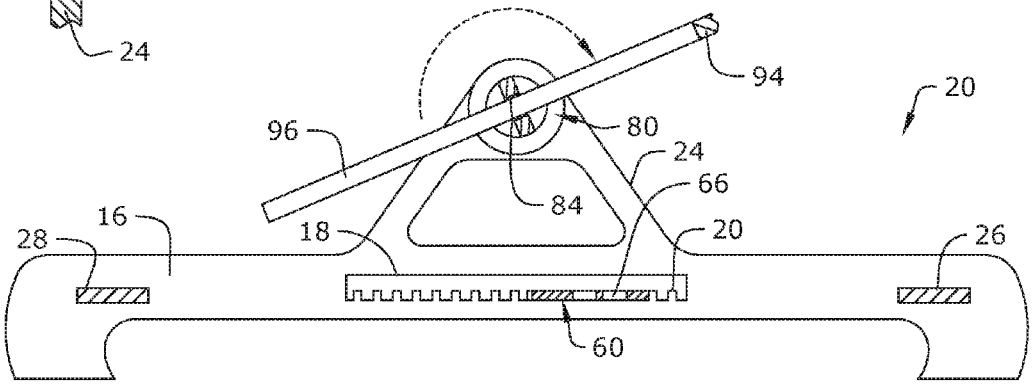
FIG. 8 shows a section view of one embodiment of the present invention taken along line 8-8 in FIG. 6.
Figure 9:
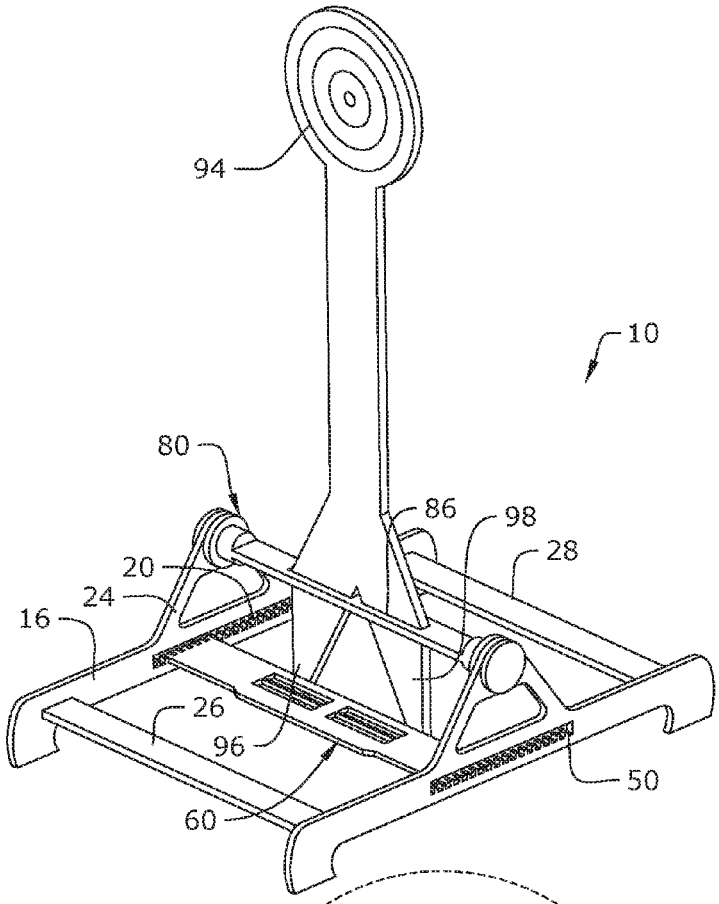
FIG. 9 shows a perspective view of one embodiment of the present invention.
Figure 10:
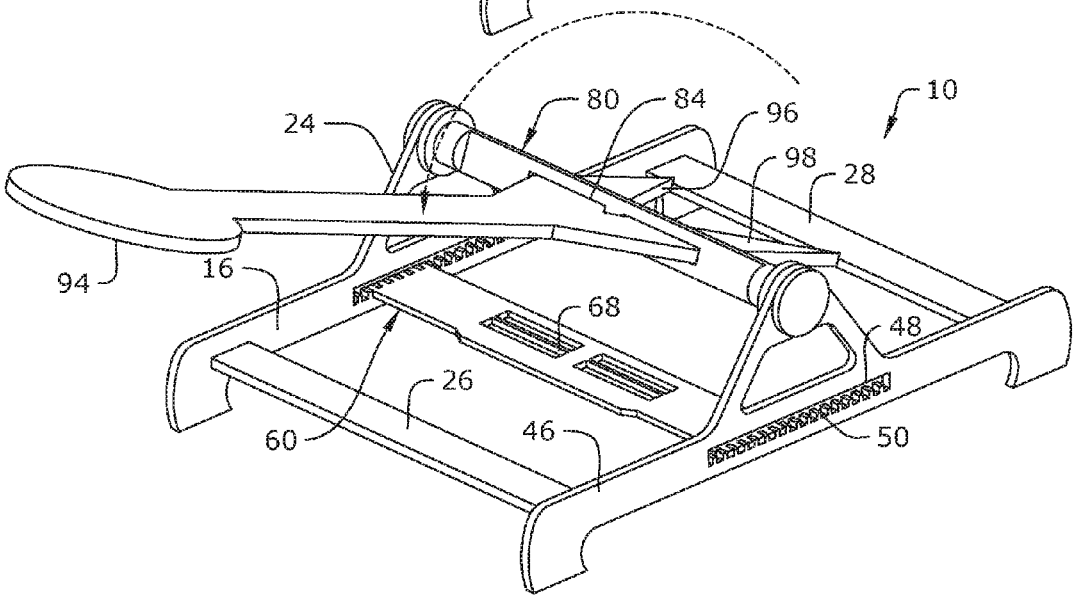
FIG. 10 shows a perspective view of one embodiment of the present invention in use.

By way of example, and referring to FIGS. 1-10, one embodiment of target holding system 10 comprises first bracket 12. First bracket 12 further comprises first bracket first foot 14 joined to first bracket central portion 16. First bracket central portion 16 is further comprises first bracket central opening 18. First bracket central opening 18 further comprises first bracket alignment teeth 20. First bracket central portion 16 is further attached to first bracket second foot 22. First bracket first foot 14 and first bracket second foot 22 operate to elevate first bracket central portion 16 from a ground surface. First bracket central portion 16 is further attached to first bracket elevated portion 24.

First bracket first foot 14 is attached to first lateral support 26. First bracket second foot 22 is attached to second lateral support 28. First lateral support 26 and second lateral support 28 are attached to second bracket 42.

Second bracket 42 further comprises second bracket first foot 44 joined to second bracket central portion 46. Second bracket central portion 46 is further comprises second bracket central opening 48. Second bracket central opening 18 further comprises second bracket alignment teeth 50. Second bracket central portion 46 is further attached to second bracket second foot 52. Second bracket first foot 44 and second bracket second foot 52 operate to elevate second bracket central portion 46 from a ground surface. Second bracket central portion 46 is further attached to second bracket elevated portion 54.

Central plate 60 has a generally rectangular shape that is modified as follows. Central plate 60 further comprises central plate first side key 62 which is adapted to mate with first bracket alignment teeth 20. Central plate 60 further comprises central plate second side key 64 which is adapted to mate with second bracket alignment teeth 50. Central plate 60 further comprises first side first opening 66, first side second opening 68, second side first opening 70, and second side second opening 72.

First bracket elevated portion 24 and second bracket elevated portion 54 are further attached to rotating rod 80, which can freely rotate around central axis 82. Rotating rod 80 further comprises first side slot 84 and second side slot 86.

Target assembly 90 further comprises central stem 92. Central stem 92 is connected to circular target 94, first side leg 96 and second side leg 98.

In a first mode of operation, first side leg 96 is slid through first side slot 84 and into first side first opening 66. Second side leg 98 is slid through second side slot 86 and into second side first opening 70. In the first mode of operation, when bullet B strikes circular target 94, central stem 92 does not move rotationally (except for vibration) and remains upright.

In a second mode of operation, first side leg 96 is slid through first side slot 84 and is adjacent to central plate 60. Second side leg 98 is slid through second side slot 86 and is adjacent to central plate 60. In the second mode of operation, when bullet B strikes circular target 94, central stem 92 moves rotationally and downward.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. §112, ¶6. In particular, any use of "step of" in the claims is not intended to invoke the provision of 35 U.S.C. §112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A target holding system, configured to be struck by a bullet, the target holding system, comprising:

a first bracket, connected to a second bracket with a first lateral support and a second lateral support;

wherein the first bracket further comprises:

a first bracket first foot joined to a first bracket central portion;

a first bracket central opening formed within the first bracket central portion and further comprising first bracket alignment teeth along an entire length of the first bracket central opening;

a first bracket second foot, attached to the first bracket central portion; wherein the first bracket first foot and the first bracket second foot operate to elevate the first bracket central portion from a ground surface; and a first bracket elevated portion, attached to the first bracket central portion;

wherein the second bracket further comprises:

a second bracket first foot joined to a second bracket central portion;

a second bracket central opening formed within the second bracket central portion and further comprising second bracket alignment teeth along an entire length of the second bracket central opening;

a second bracket second foot, attached to the second bracket central portion; wherein the second bracket first foot and the second bracket second foot operate to elevate the second bracket central portion from the ground surface; and a second bracket elevated portion, attached to the second bracket central portion;

a central plate, connected to the first bracket central opening and the second bracket central opening and further comprising a first side first opening and a second side first opening; wherein the central plate further comprises:

a central plate first side key, further comprising a plurality of first side mating teeth arranged along an entirety of a first side of the central plate and adapted to mate with the first bracket alignment teeth in a plurality of positions along the first bracket central opening; and a central plate second side key, further comprising a plurality of second side mating teeth arranged along an entirety of a second side of the central plate and adapted to mate with the second bracket alignment teeth in a plurality of positions along the second bracket central opening;

a rotating rod, rotatably connected to the first bracket elevated portion and the second bracket elevated portion and further comprising a first side slot and a second side slot; and a target, further comprising a central stem connected to a circular target, a first side leg and a second side leg;

wherein a first mode of operation, the first side leg is configured to slide through the first side slot and into the first side first opening while the second side leg is slid through second side slot and into the second side first opening; wherein when the bullet strikes the circular target, the central stem remains upright;

wherein a second mode of operation, the first side leg is configured to slide through the first side slot and is adjacent to the central plate while the second side leg is slid through the second side slot and is adjacent to the central plate; wherein when the bullet strikes the circular target, the central stem moves rotationally and downward.

* * * * *